United States Patent [19]

Gemelli et al.

[11] Patent Number: 5,032,245

[45] Date of Patent: Jul. 16, 1991

[54] RETICULATE ELECTRODE BUS CONNECTION

[75] Inventors: Alfiero Gemelli, Carouge, Switzerland; Yves Pellet, Prevessin-Moens, France; James J. Stewart, Chardon, Ohio

[73] Assignee: Eltech Systems Corporation, Boca Raton, Fla.

[21] Appl. No.: 460,694

[22] Filed: Jan. 4, 1990

[51] Int. Cl.[5] ..... C25C 7/00; C25C 7/02

[52] U.S. Cl. ..... 204/242; 204/279; 204/280; 204/286; 204/284; 429/40; 429/211

[58] Field of Search ..... 204/280, 286, 279, 242, 204/284; 429/40, 211

[56] References Cited

U.S. PATENT DOCUMENTS

| | | | |
|---|---|---|---|
| 2,723,230 | 11/1955 | Godsey, Jr. | 204/286 |
| 4,399,020 | 8/1983 | Branchick et al. | 204/269 |
| 4,515,672 | 5/1985 | Platek et al. | 204/269 |

*Primary Examiner*—John F. Niebling

*Assistant Examiner*—Kathryn Gorgos

*Attorney, Agent, or Firm*—John J. Freer

[57] ABSTRACT

The present invention resides in a guide for a reticulate electrode bus connector. The guide comprises a body portion having an upper surface. A pair of spaced apart legs depend downwardly from a body portion and define with the body portion a guide longitudinal dimension. The legs define a longitudinally extending slot dimensioned to accommodate the reticulate electrode. The legs comprise planar, facing inner surfaces adapted to press against opposite sides of the electrode. A longitudinally extending ductway extends from the body portion upper surface to a slot. The ductway is aligned with a center line of the slot intermediate the planar facing inner surfaces. A plurality of openings extend through each of the legs communicating with the slot. The openings expose a substantial portion of the surface area of the reticulate electrode within the confines of the slot and are substantially uniformly disposed along the legs.

24 Claims, 2 Drawing Sheets

RETICULATE ELECTRODE BUS CONNECTION

BACKGROUND OF THE INVENTION

1. Technical Field

The present invention relates to a reticulate electrode bus connection, and particularly to a novel guide for attaching a wire bus connection to a reticulate electrode. The present invention is particularly applicable to attaching a wire bus connection to a reticulate cathode for an electrochemical cell or a battery.

2. Description of the Prior Art

Reticulate electrodes are well known and disclosed in numerous prior patents and publications. The common dictionary definition of the term "reticulate" is resembling a net or network having a plurality of crossing fibers. A reticulate electrode is a form of "high surface area" or "flow-through" electrode. In use, the electrode is immersed in an electrolytic solution of an electrochemical cell or battery. Reticulate electrodes are particularly useful with dilute electrolytic solutions because they provide more surface area for the capture of ions in the solutions. The electrodes are "flow-through" in the sense that they have an interconnected open-cell structure through which the electrolytic solution flows.

Prior U.S. Pat. No. 4,515,672, assigned to the assignee of the present application, discloses reticulate electrodes and methods for making them. The reticulate electrodes are made from an open cell polymer foam such as a polyurethane foam which has been made conductive, for instance by coating with carbon particles. The conductive foams typically have a resistivity in the range of about 50–500 ohm-cm, a pore size in the range of about 10 ppi (pores per inch) to about 100 ppi, the pores ranging from about 2 mm to about 0.15 mm in diameter, and a void fraction in the range of about 0.5 to about 0.98. The conductive foams are in the shape of a parallelepiped having a thickness which may range from about 0.2 inch to about 0.5 inch. The width and height of the foams are arbitrary since the electrodes are adapted for the particular cell box or battery casing with which they are used. The surface area of a conductive foam is substantial. A conductive foam which has a thickness of about 0.25 inch, a width of about 18 inches and a length of about 14.19 inches has a volume of about 63.9 cubic inches. A foam of about 25 ppi of this volume has an active surface area of about 425 square feet.

The conductive foams can be plated with a conductive metal, for instance copper or nickel. The thickness of the metal plating can vary widely. The reticulate electrodes, following plating, may be pyrolyzed to remove the polymer substrate leaving a reticulate metal structure. Alternatively, they may be used without pyrolysis. The reticulate electrodes may or may not be subjected to metal annealing, depending upon application. The disclosure of prior U.S. Pat. No. 4,515,672 is incorporated herein by reference.

Electrically connecting the reticulate electrodes to a battery or electrolytic cell bus has been a substantial problem in the art. It is necessary for any connection to have a large area of contact with the reticulate electrode because of the large amount of the current flow through the electrode. In addition to being electrically adequate, the connection must be mechanically strong. Any reduction in the contact area with the reticulate electrode during use can result in the corrosion of component parts. Such corrosion, by way of example, has been experienced with the use of alligator clamps positioned at or just above the air-liquid interface level in a cell or battery.

Prior U.S. Pat. No. 4,515,672 discloses one mode of connecting a reticulate electrode to a battery or cell bus. A support comprises a solid metal plate which overlies the entire surface area of at least one face of the reticulate electrode. The plate is affixed to the reticulate electrode by a plurality of staples, pins or other fastening means. A connector tab protrudes upwardly from the support plate to provide a convenient connection with the battery or cell bus. The support plate is provided with apertures through which the cell electrolyte or solution ions can flow.

Prior U.S. Pat. No. 4,399,020 discloses reticulate electrodes and their use in electrochemical cells and batteries. This patent also discloses methods for the manufacture of the reticulate electrodes. As with the disclosure of U.S. Pat. No. 4,515,672, the disclosure of U.S. Pat. No. 4,399,020 is incorporated herein by reference.

The '020 patent discloses contact bars with extensions which serve as a means for electrical connection with the electrode bus bar. The contact bars are formed of U-shaped galvanized sheet metal. They are secured to a reticulate electrode by slipping them over the upper edge of the electrode and pinching or pressing the sheets together at selected areas along the length of the electrode. A wire lead extends between the electrode bus bar and the contact bar extensions.

Prior application Ser. No. 308,907, entitled "Reticulate Electrode and Cell for Recovery of Metals From Waste Waters", assigned to the assignee of the present application, discloses the use of reticulate cathodes in an electrolytic cell. The reticulate cathodes extend across the width of the cell and seat in aligned vertical slots on the inside of side walls of the cell. The cell is provided with elongated anode and cathode bus bars adjacent the upper edges of the cell side walls. Each bus bar has a plurality of bus terminals spaced along the bus bar. The cathode bus terminals are aligned with the cathode slots. A hook-shaped wire connector pin extends between each reticulate cathode and its cathode bus terminal. At the hook end, the connector pin can seat within a hole in the bus terminal. The bus terminal is externally threaded. A lock nut threaded onto the bus terminal is turned to press the connector pin hook end against the bus bar. An advantage of the cathode assembly of prior application Ser. No. 308,907 is that it provides excellent electrical connection between the reticulate cathode and the connector pin. In addition, the assembly provides a high resistance against accidental separation of the reticulate cathode and the connector pin. The disclosure of prior application Ser. No. 308,907 is also incorporated herein by reference.

SUMMARY OF THE INVENTION

The present invention resides in a guide for a rigid, wire, reticulate electrode bus connector. The guide comprises a body portion having an upper surface. A pair of spaced apart legs depend downwardly from said body portion and define with the body portion a guide longitudinal dimension. The legs define a longitudinally extending slot dimensioned to accommodate the reticulate electrode. The legs comprise planar, facing inner surfaces adapted to press against opposite sides of the electrode. A longitudinally extending ductway extends from said body portion upper surface to said slot. The ductway is aligned with a center line of said slot intermediate said planar facing inner surfaces. A plurality of openings extend through each of said legs communicating with said slot. The openings expose a substantial portion of the surface area of the reticulate electrode within the confines of said slot and are substantially uniformly disposed along the legs.

In operation, the reticulate electrode and bus connector are assembled by positioning the guide over an upper edge of the reticulate electrode so that the electrode seats within the guide slot and the upper edge of the electrode bears against the underside of the guide body portion. The bus connector is then fed into the guide ductway and pressed downwardly into the reticulate electrode. The distance of penetration into the electrode by the bus connector is that necessary to establish both an effective mechanical connection with the electrode and an effective electrical connection.

The length of the guide legs in relation to the penetration of the bus connector into the reticulate electrode is an amount effective to prevent the bus connector from protruding substantially from a side of the reticulate electrode and thereby reduce the area of contact of the bus connector with the electrode and/or injure the person assembling the bus connector and electrode.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENTS

Figure 2:
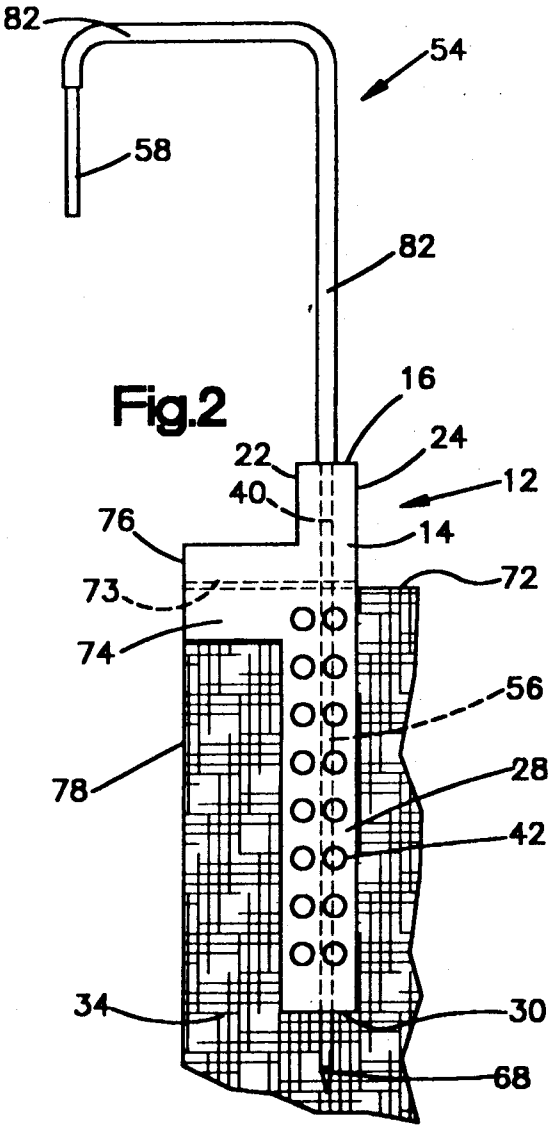
FIG. 2 is an enlarged, elevation view of the guide of FIG. 1, this Figure also showing a portion of the reticulate electrode and the bus connector.
Figure 4:
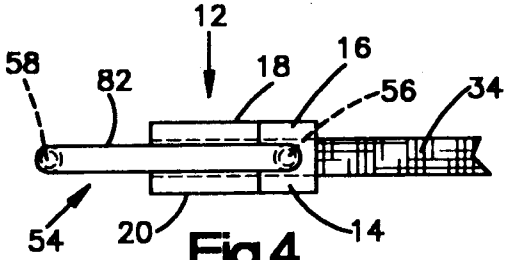
FIG. 4 is a top view of the guide, electrode and bus connector of FIG. 2.
Figure 3:
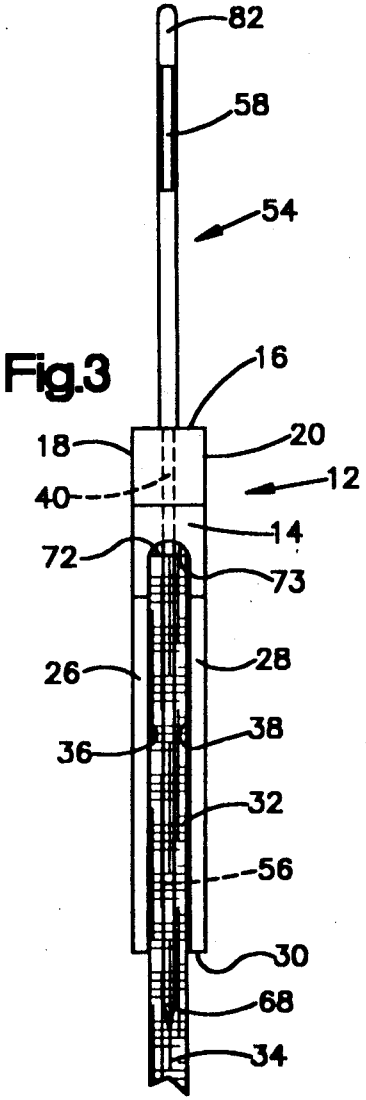
FIG. 3 is an elevation end view of the guide, electrode and bus connector of FIG. 2.

Referring to FIGS. 2–4, guide 12 comprises a main body portion 14, which in the embodiment illustrated, is substantially cubical. The body portion comprises an upper surface 16, sides 18 and 20 (FIG. 3), and end faces 22 and 24 (FIG. 2). Legs 26 and 28 (FIG. 3) depend downwardly from the body portion 14. The legs 26 and 28 define with the body portion 14 a longitudinal dimension which extends from the upper surface 16 of the guide to the bottom 30 of legs 26, 28. The legs 26, 28 are spaced apart and define a longitudinally extending slot 32 (FIG. 3). The slot 32 is dimensioned to accommodate a reticulate electrode 34. The legs have planar facing inner surfaces 36, 38 which press against opposite sides of the electrodes 34. A longitudinally extending ductway 40 (FIGS. 2 and 3) extends from the body portion upper surface 16 to the slot 32. The ductway is intermediate sides 18, 20 (FIG. 3) and is aligned with the center line of the slot 32 which, in turn, is intermediate planar facing inner surfaces 36, 38 (in the view of FIG. 3).

A plurality of openings 42 (FIG. 2) extend through each of the legs 26, 28 communicating with the slot 32. The openings 42 preferably extend horizontally at right angles to the slot center line. The openings 42 are dimensioned and spaced to expose a substantial portion, preferably as much as possible of the surface area of the electrodes 34 within the confines of the slot 32; for instance about 25% to 50% or more. The openings 42 are substantially uniformly disposed along the legs 26, 28.

The guide 12 is preferably made by injection molding. Broadly, the guide can be made of any semi-rigid plastic, polymeric material that can be injection molded or machined. The polymeric material should be electrically non-conductive and inert to the electrochemical contents of a cell or battery. Examples of moldable or machineable polymeric materials that can be used are polyolefins, such as polypropylene and polyethylene, and polyhalocarbons such as polyvinylchloride (PVC).

Figure 1:
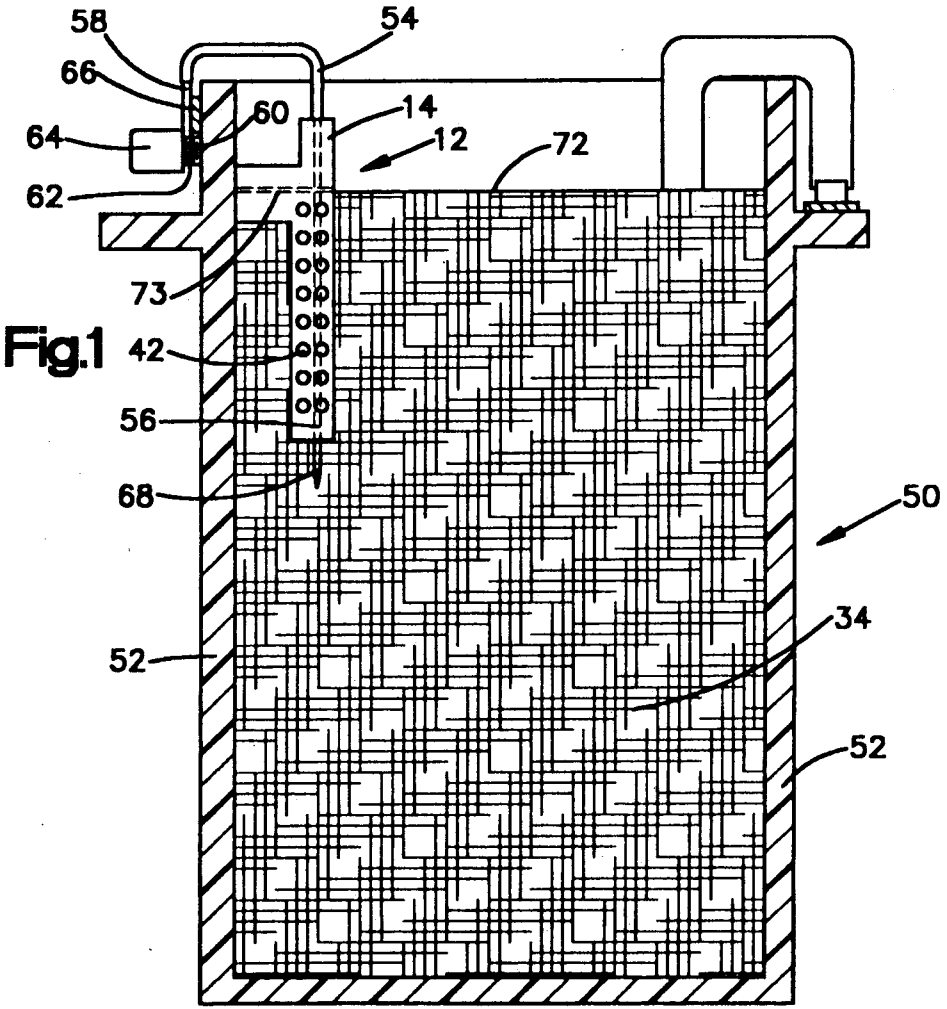
FIG. 1 is an elevation section view of an electrolytic cell showing a reticulate electrode, a bus connector therefor, and a guide in accordance with one embodiment of the present invention.

FIG. 1 shows an electrolytic cell 50 and reticulate electrode 34 positioned within the cell. The cell 50 is provided with a plurality of slots (not shown) along the inside of side walls 52 of the cell. The reticulate electrode 34 is held within the slots. The cell 50 contains an electrolyte (not shown) having a composition which is dependent upon the use for the cell. The electrode 34 is a reticulate electrode such as disclosed in prior U.S. Pat. Nos. 4,515,672 and 4,399,020. Also, the electrode can be a reticulate electrode such as disclosed in prior application Ser. No. 308,907. The reticulate electrode 34 permits the flow of electrolyte in the cell through the electrode. The reticulate electrode 34 has, as indicated above, an open porous construction and thus has a high surface area. Such surface area is particularly advantageous for use with relatively dilute process streams which have a relatively low concentration of reactive ions. Since the ions have to find their way to the surface of the electrode, the greater the surface area, the more efficient the reaction within the cell.

In the embodiment of FIGS. 1–4, the bus connection for the reticulate electrode comprises a rigid, wire bus connector 54 which is in the form of a crook, having a relatively straight shank 56 (FIG. 2) and an upper hooked end 58. The bus connector 54 is made of a bendable, electrically conductive wire. The wire should be inert to the electrochemical contents of the cell or battery. Examples of suitable wire materials are copper, copper wire coated with nickel, and galvanized iron. The hooked end 58 seats into opening 60 (FIG. 1) of a bus terminal 62 mounted on a side 52 of cell 50, as more particularly shown in application Ser. No. 308,907. The terminal 62 is connected to a cell cathode bus 66 which extends lengthwise on the cell near the upper edge of the cell side wall 52. The terminal 62 is externally threaded. A knurled knob 64 is threaded onto the terminal 62 and when turned presses the hooked end 58 of the bus connector inwardly against the cathode bus 66.

The bus connector shank 56 has a tapered shank end 68. In operation, the reticulate electrode 34 and the guide 12 are first assembled by placing the guide 12 over the upper edge 72 (FIG. 3) of the electrode. The guide is pressed downwardly until the underside 73 of the guide body portion 14, at the top of slot 32, presses against or pinches the electrode upper edge 72, i.e., seats against the electrode upper edge. The guide 12 has an arm 74 (FIG. 2) which extends laterally from the body portion 14 at right angles to the guide ductway 40. The arm 74 has a remote edge 76 spaced from the ductway 40. During assembly, the remote edge 76 of the guide arm 74 is aligned with the electrode edge 78. The bus connector shank 56 is then inserted into the guide ductway 40 and is pressed downwardly so that the bus connector tapered end 68 extends into the electrode 34. The bus connector 54 has an insulation covering 82 which covers the bus connector 54 along most of the upper hooked end 58 and part of the bus connector shank 56. The bus connector is pressed downwardly into the electrode 34 impaling the electrode until the insulation covering 82 seats against the upper edge 16 of guide 14. As shown in FIGS. 1, 2, and 3, the length of the covering 82 along the shank 56 is such that the bus connector tapered end 68 extends only slightly below the bottom edge of the guide legs 26, 28.

The insulation covering 82 can be any rubberized or elastomeric material that is resistant to the electrochemical contents of the cell or battery, that is electrically nonconductive, and that is relatively heat resistant. Examples of suitable materials are fluoroelastomers based on the copolymer of vinylidene fluoride and hexafluoropropylene marketed by E. I. DuPont deNemours & Co. under the trademark "VITON"; polytetrafluoroethylene; and silicone resins.

If desired, the guide arm 74 can contain a plurality of openings, similar to openings 42, to expose additional surfaces of the reticulate electrode 34.

From the above, it will be apparent that the guide 12 serves multiple purposes. The guide legs 26, 28 function to guide the bus connector shank 56 so that it maintains maximum contact with the electrode 34 while being inserted within the electrode. The guide 12 also functions to prevent injury by the shank 56 to the person assembling the electrode and bus connector. The guide 12 further properly aligns the bus connector shank 56 in from edge 78 of the electrode, which, in turn, properly aligns the bus connector hooked end 58 with opening 60 in the bus terminal 62, when the electrode 34 is placed in cell 50. The upper surface 16 of the guide 12 limits the amount of penetration of the bus connector into the electrode 34 so that, for example, the hooked end 58 of the bus connector properly seats into the opening 60 of the bus terminal 62, when the electrode 34 is placed within the cell 50.

In the embodiment of FIGS. 1–4, the bus connector 54 is a rigid electrically conductive wire resistant to corrosion by the electrolyte, for instance, a number ten or number twelve copper wire. The reticulate electrode has a typical thickness of about 0.25 inch, although generally this may vary from about 0.1 to about 0.5 inch. The wire bus connector 54 is impaled into the reticulate electrode 34 a distance of about three inches. These dimensions can vary depending upon the particular application involved.

The purpose of openings 42 in the guide legs 26, 28 is to expose as much of the electrode 34, shadowed by the guide legs 26, 28, to the electrolyte within cell 50. This increases the overall exposure of the electrode 34 to electrolyte. In addition, in most electrochemical processes, there will be some net deposition of metal on the electrode from the electrochemical process. The openings 42 permit such deposition of metal in the area shadowed by the guide legs. This, in effect, solders the bus connector shank 56 to the electrode enhancing the mechanical and electrical connection of the bus connector with the electrode.

Figure 6:
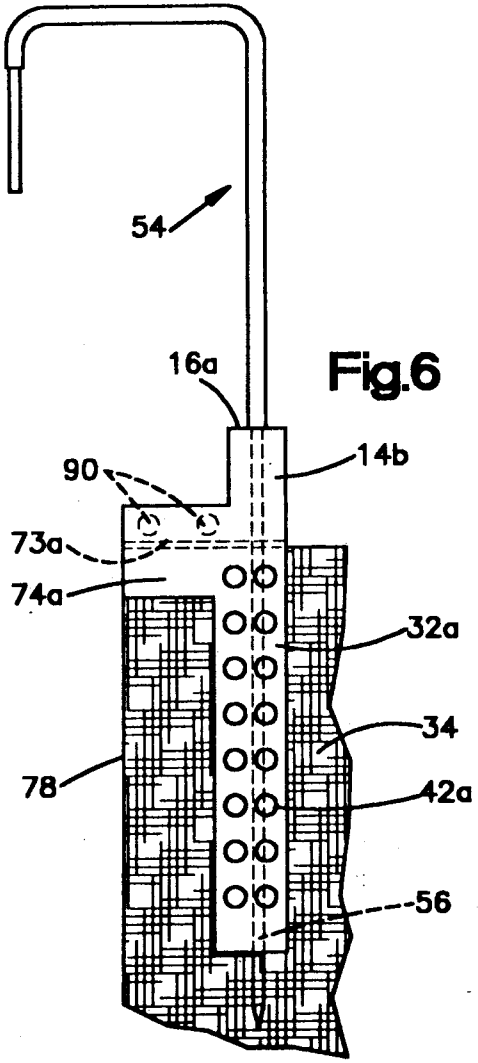
FIG. 6 is an elevation side vie of the embodiment of FIG. 5.
Figure 5:
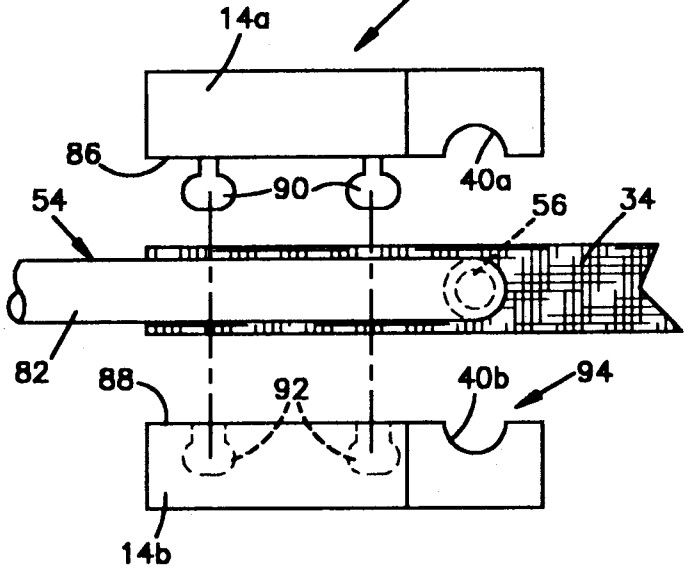
FIG. 5 is an enlarged top view of a guide for a reticulate electrode bus connector in accordance with an embodiment of the present invention.

An embodiment of the present invention is shown in FIGS. 5 and 6. In this embodiment, the guide 14 is separable in two guide halves **14*a* and 14*b* (FIG. 5). The guide halves 14*a*, 14*b* are separable along a line of separation defined by surfaces 86, 88. The surfaces 86, 88 are aligned with the axis of ductway 94 defined by indents 40*a*, 40*b* in the surfaces 86, 88. The guide halves 14*a*, 14*b* when separated along the line of separation defined by surfaces 86, 88, are in overall outline, mirror images of each other. The guide halves 14*a*, 14*b* can be coupled together by a coupling means which, in the embodiment shown in FIG. 5, is a ball and socket snap coupling comprising a pair of spaced apart male buttons 90 attached to guide half 14*a* and a pair of complementary female sockets 92 in guide half 14*b*. The coupling buttons 90 and sockets 92 are positioned, in the embodiment shown, in the guide arm 74*a* intermediate slot 32*a* and upper surface 16*a* of the guide, as shown in FIG. 6**. Other modes of fastening the guide halves or guide member sections together can be employed, such as hooks and eyes on surfaces of the guide halves or member sections.

In the embodiment of FIGS. 5, 6, the electrode assembly is assembled by positioning the guide halves or guide member sections **14*a*, 14*b* on opposite sides of the electrode, and then snapping the guide halves together. Once snapped together, the bus connector 54 is inserted into the electrode 34, in the same manner as in the embodiment of FIGS. 1–4. The advantage of the embodiment of FIGS. 5, 6 is that the guide can easily be removed from a spent electrode 34, prior to disposal of the electrode, simply by pulling apart the guide halves or member sections 14*a*, 14*b*. This can be done without removal of the bus connector 54 from the electrode 34**, which pin may be soldered to the electrode. This permits the guide to be reused with a fresh electrode.

From the above description of preferred embodiments of the invention, those skilled in the art will perceive improvements, changes and modifications. Such improvements, changes and modifications within the skill of the art are intended to be covered by the appended claims.

What is claimed is:

1. A guide for a reticulate electrode and a rigid wire bus connector therefor comprising:

a body portion comprising an upper edge and spaced-apart sides;

a pair of spaced-apart downwardly extending guide legs depending from said body portion, said legs defining a slot adapted to accommodate a reticulate electrode, said legs pressing against opposite sides of said spaced apart electrode;

a ductway intermediate said sides extending vertically through said body portion communicating with said slot, said ductway being dimensioned to accommodate said wire bus connector; and a plurality of horizontally extending openings in said legs communicating with said slot adapted to allow electrolyte to flow into said slot.

2. The guide of claim 1 wherein said openings expose a substantial surface area of said electrode with said slot and are substantially uniformly disposed along said legs.

3. The guide of claim 1 wherein said legs comprise facing planar inner surfaces adapted to press against the opposite sides of said electrode.

4. The guide of claim 1 further comprising an arm extending laterally from said body portion having a terminal edge adapted to be aligned with an edge of said electrode for positioning said guide with respect to said edge of said electrode.

5. The guide of claim 1 separable into halves along a line of separation aligned with said guide slot, further comprising coupling means for coupling separable halves together.

6. A reticulate electrode assembly for electrolytic cells comprising:

(a) a flat, reticulate electrode having an upper edge and opposite sides depending from said upper edge;

(b) a rigid wire bus connector adapted to penetrate into said reticulate electrode from said upper edge;

(c) a guide for said wire bus connector, said guide comprising:

(1) a guide body portion having an upper edge and space-apart sides, (2) a pair of spaced-apart guide legs depending downwardly from said body portion away from said upper edge, said legs defining an elongated guide slot, (3) a ductway intermediate said spaced-apart sides extending vertically through said body portion communicating with said slot, said ductway being dimensioned to accommodate said wire bus connector, (4) said guide body portion being seated on said electrode upper edge with said elongated slot accommodating said electrode, said legs pressing against opposite electrode sides, and (5) a plurality of apertures in said legs exposing said electrode to electrolyte in electrolytic cells through said legs.

7. The reticulate electrode assembly of claim 6 wherein said guide apertures expose a substantial surface area of said electrode within said slot and are substantially uniformly disposed along said legs.

8. The reticulate electrode assembly of claim 6 wherein the wire bus connector penetrates into said reticulate electrode a distance necessary to establish both a mechanical connection and an electrical connection of the wire bus connector with such reticulate electrode.

9. The reticulate electrode assembly of claim 8 wherein said guide legs have a length substantially the same as the distance of penetration of the bus connector into the reticulate electrode.

10. The reticulate electrode assembly of claim 6 wherein said guide legs comprise facing planar inner surfaces pressing against opposite sides of said electrode.

11. The reticulate electrode assembly of claim 6, said guide further comprising an arm extending laterally with respect to said guide slot from said guide body portion, said arm having a terminal edge aligned with an edge of said electrode positioning said guide with respect to the edge of said electrode.

12. The reticulate electrode assembly of claim 6, said guide being separable into halves along a line of separation aligned with said guide slot, further comprising coupling means for coupling said guide halves together.

13. An electrolytic cell comprising:

(a) at least one planar reticulate electrode comprising an upper edge and opposite sides depending from said upper edge;

(b) at least one rigid wire bus connector penetrating into said reticulate electrode from said upper edge;

(c) at least one guide for said wire bus connector comprising:

(1) a body portion having an upper edge and spaced-apart sides, (2) a pair of spaced apart guide legs depending downwardly from said body portion away from said upper edge, said legs defining an elongated guide slot, (3) a ductway intermediate said spaced apart sides extending vertically through said body portion communicating with said slot, said ductway being dimensioned to accommodate said wire bus connector, (4) said guide body portion being seated on said electrode upper edge with said elongated slot accommodating said electrode, said legs pressing against said electrode opposite sides, and (5) a plurality of apertures in said legs exposing said electrode to electrolyte in said cell through said legs.

14. The electrolytic cell of claim 13 wherein said guide apertures expose a substantial surface area of said electrode within said slot and are substantially uniformly disposed along said legs.

15. The electrolytic cell of claim 13 wherein the wire bus connector penetrates into said reticulate electrode a distance necessary to establish both a mechanical connection and an electrical connection of the wire bus connector with such reticulate electrode.

16. The electrolytic cell of claim 15 wherein said guide legs have a length substantially the same as the distance of penetration of said wire bus connector into the reticulate electrode.

17. The electrolytic cell of claim 13 wherein said guide is plastic.

18. The electrolytic cell of claim 13 wherein said guide further comprises an arm extending at right angles from said body portion and having a free edge spaced from said body portion, said free edge being aligned with an edge of said electrode positioning said guide with respect to said electrode.

19. The electrolytic cell of claim 13 wherein said guide legs comprise inside planar facing surfaces pressing against opposite sides of said electrode.

20. The electrolytic cell of claim 13 wherein said guide is separable into two halves, further comprising coupling means coupling said halves together.

21. A guide member section for a reticulate electrode and a rigid wire bus connector therefor, said guide member section comprising:

a body portion comprising an upper edge and spaced-apart sides;

a downwardly extending leg depending from said body portion, said leg serving with an opposing guide member section leg to define a slot adapted to accommodate a reticulate electrode, said leg in use pressing against a side of said electrode;

an indentation intermediate said spaced apart sides extending vertically through said body portion communicating with said slot, said indentation being dimensioned to at least partly accommodate said wire bus connector;

a plurality of horizontally extending openings in said leg communicating with said slot adapted to allow electrolyte flow into said slot; and means for coupling said guide member section to the opposing guide member section.

22. A reticulate electrode assembly for electrolytic cells comprising:

(a) a flat, reticulate electrode having an upper edge and opposite sides depending from said upper edge;

(b) a guide for a bus connector, said guide comprising an upper body portion and a pair of elongated, spaced-apart legs having a plurality of horizontally extending openings depending downwardly from said body portion; and (c) a rigid wire bus connector having a shank with a tapered end penetrating into said reticulate electrode through said guide

23. The electrode assembly of claim 22 wherein said tapered end extends into said reticulate electrode beyond said downwardly depending legs.

24. The electrode assembly of claim 22 wherein said shank is soldered to said reticulate electrode by electrodeposition of metal contained in electrolyte flowing through perforations in said legs.

* * * * *

UNITED STATES PATENT AND TRADEMARK OFFICE

CERTIFICATE OF CORRECTION

PATENT NO. : 5,032,245

DATED : July 16, 1991

INVENTOR(S) : Gemelli et al

It is certified that error appears in the above-identified patent and that said Letters Patent is hereby corrected as shown below:

In Claim 1, column 6, line 52 of the Patent, after "of said" delete "spaced apart".

In Claim 1, column 6, line 53 of the Patent, after "said" insert --spaced-apart--.

Signed and Sealed this

Twenty-second Day of December, 1992

*Attest:*

DOUGLAS B. COMER

*Attesting Officer*

*Acting Commissioner of Patents and Trademarks*